US005262829A

United States Patent [19]

Rosen et al.

[11] Patent Number: 5,262,829

[45] Date of Patent: Nov. 16, 1993

[54] COMPOSITION OF MATTER USEFUL FOR FUSING OF DEVELOPED IMAGES AND METHOD AND APPARATUS USING SAME

[75] Inventors: Josef Rosen, Rehovot, Israel; Benzion Landa, Edmonton, Canada

[73] Assignee: Spectrum Sciences, B.V., Rotterdam, Netherlands

[21] Appl. No.: 879,728

[22] Filed: May 6, 1992

Related U.S. Application Data

[63] Continuation of Ser. No. 268,861, Nov. 8, 1988, abandoned, which is a continuation-in-part of Ser. No. 202,687, Jun. 6, 1988.

[51] Int. Cl.[5] ..... G03G 15/20; G03G 21/00

[52] U.S. Cl. ..... 355/282; 219/469; 355/284

[58] Field of Search ..... 355/282, 284, 285, 290, 355/295; 219/216, 469, 470

[56] References Cited

U.S. PATENT DOCUMENTS

| | | | |
|---|---|---|---|
| 3,795,033 | 3/1974 | Donnelly et al. | 29/132 |
| 3,809,854 | 5/1974 | Sanders | 219/216 |
| 3,937,919 | 2/1976 | Clerx et al. | 219/216 |
| 3,967,042 | 6/1976 | Laskin et al. | 219/216 X |
| 3,989,790 | 11/1976 | Bruner et al. | 264/225 |
| 4,137,340 | 1/1979 | Verlinden et al. | 427/16 |
| 4,185,140 | 1/1980 | Strella et al. | 355/284 X |
| 4,257,699 | 3/1981 | Lentz | 355/284 |
| 4,264,181 | 4/1981 | Lentz et al. | 355/284 |
| 4,272,179 | 6/1981 | Seanor | 355/284 X |
| 4,304,897 | 12/1981 | Bluestein | 528/20 |
| 4,357,388 | 11/1982 | Minor | 219/469 X |
| 4,360,566 | 11/1982 | Shimizu et al. | 219/469 X |
| 4,375,505 | 3/1983 | Newkirk | 219/216 X |
| 4,496,234 | 1/1985 | Schram | 355/290 X |
| 4,525,400 | 6/1985 | Surprenant | 428/54 |
| 4,567,349 | 1/1986 | Henry et al. | 355/290 X |
| 4,579,802 | 4/1986 | Kishi et al. | 118/60 |
| 4,632,855 | 12/1986 | Conlon et al. | 219/216 X |
| 4,639,405 | 1/1987 | Franke | 355/290 X |
| 4,763,158 | 8/1988 | Schlueter | 355/284 |
| 4,796,046 | 1/1989 | Suzuki et al. | 355/284 |
| 4,806,593 | 2/1989 | Kress et al. | 525/63 |
| 4,810,564 | 3/1989 | Takahashi et al. | 355/284 |
| 5,037,886 | 8/1991 | Blizzard et al. | 525/105 |

FOREIGN PATENT DOCUMENTS

| | | |
|---|---|---|
| 0254498 | 1/1988 | European Pat. Off. . |
| 56-104364 | 8/1981 | Japan . |

OTHER PUBLICATIONS

Patent Abstract of Japan, vol. 5 No. 56-87073.
Patent Abstract of Japan vol. 10 No. 60-176073.
Patent Abstract of Japan vol. 11 No. 61-186975.
Patent Abstract of Japan No. 58-209768.
Patent Abstract of Japan No. 59-46664.
European Search Report.

*Primary Examiner*—Fred L. Braun
*Attorney, Agent, or Firm*—Sandler, Greenblum & Bernstein

[57] ABSTRACT

A composition of matter including: (A) a release coating silicone polymer; (B) a cross-linker for (A) in an amount insufficient to substantially cross-link (A); and (C) a soft silicone rubber formulation, the weight ratio of (A) to (C) being in the range of from about 1:1.5 to 1:20. The composition is useful in the manufacture of fuser rollers.

67 Claims, 2 Drawing Sheets

70
64
68
54
52
50
58
56
54
54
44
60
48
62
12
46
100
32
36
6
4
8
10
9
34
38
14
15
2
22
22
24
25
16
26
28
18
20

COMPOSITION OF MATTER USEFUL FOR FUSING OF DEVELOPED IMAGES AND METHOD AND APPARATUS USING SAME

This application is a continuation of application Ser. No. 07/268,861, filed Nov. 8, 1988, now abandoned; which is a continuation-in-part of application Ser. No. 07/202,687, filed Jun. 6, 1988, now pending.

FIELD OF THE INVENTION

The present invention relates generally to a composition and method for reducing the adhesitivity of the surface of an article in electrostatic imaging.

BACKGROUND OF THE INVENTION

In known processes of electrostatic imaging, a light image of an original to be copied may be recorded in the form of an electrostatic latent image upon a photoconductive member. A developed image may then be obtained from the latent image by application of toner particles, which may be in the form of a finely powdered solid or in liquid phase.

In 'dry' electrostatic imaging processes which employ powdered solid toners, it is known to pass a substrate having a developed image formed thereon between (for example) a pair of opposed rollers. One or both of the rollers is heated and in consequence heats and thereby fuses and fixes the image on the substrate, insofar as at least to some extent the image particles flow into the fibers or pores of the substrate. For prior patents in the field of fusing and fixing the developed image, reference is made to U.S. Pat. Nos. 3,249,738, 3,637,976, 3,667,742, 3,718,116 and 4,689,471 the disclosures of which are incorporated herein by reference.

In dry electrostatic imaging processes as described above, unintended offsetting of the developed image onto one of the rollers may occur. It is known that the incidence of offsetting may be reduced by employing a roller covered with polytetrafluoroethylene or silicone rubber, to which a release agent such as silicone oil is applied, which release agent apparently forms an interface between the roller surface and the toner images on the support.

As has been indicated above, liquid toner based electrostatic imaging is known. The basic steps of the liquid toner process are:

1. Generating an electrostatic latent image, e.g. on a photoconductive surface such as a plate or drum which has been sensitized by charging with a corona discharge and by exposure to light in the form of an image of an object—the charge is dissipated in exposed areas;

2. Developing the latent image by contact with a liquid dispersion ("toner") of fine particles which in a positive process are attracted to the charged areas and which in a reverse process are attracted to the uncharged areas;

3. Removal of excess liquid toner and particles from the background areas;

4. Transfer of the image, e.g. to a substrate such as paper, under influence of an electrical field;

5. Fixing the image by fusing the particles together and to the substrate; and

6. Cleaning the plate or drum for reuse.

In this connection reference is made to the following published patent applications and issued patents in the field of electrophotography: GB Published Patent Applications Nos. 2,169,416A and 2,176,904A and U.S.

Pat. Nos. 3,990,696, 4,233,381, 4,253,656, 4,256,820, 4,269,5o4, 4,278,884, 4,286,039, 4,302,093, 4,326,644, 4,326,792, 4,334,762, 4,350,333, 4,355,883, 4,362,297, 4,364,46o, 4,364,657, 4,364,661, 4,368,881, 4,378,422, 4,392,742, 4,396,187, 4,4oo,079, 4,411,976, 4,412,383, 4,413,048, 4,418,903, 4,420,244, 4,435,o68, 4,439,035, 4,454,215, 4,46o.667, 4,473,865, 4,480,825, 4,501,486, 4,522,484, 4,531,824, 4,538,899, 4,582,774, 4,585,329, 4,586,81o, 4,589,761, 4,598,992, 4,603,766, 4,620,699, 4,627,705 and 4,678,317, the disclosures of all of which are incorporated by reference herein.

Following development, the excess liquid toner and particles are removed from the image, by a step often referred to as "metering". This step may be carried out by use of an electrically biased reverse roller which also shears off the "fluffy" part of the imaged regions and squeezes or compacts the imaged area to prepare it for transfer. At the transfer stage, there is likely to occur a degree of smudging, smearing or squashing of the image, which detracts from its quality. It will be appreciated that if in the fusing and fixing stage, heat and pressure are applied to the liquid toner image, as has been described above for solid toner based processes, the liquid image will be likely to again suffer from smudging, smearing or squashing.

In Published UK Patent Application GB 2169416A (Landa et al), the disclosure of which is incorporated herein by reference, a degree of squash-resistance is imparted to the developed image by using fibrous toner particles prepared as follows: a thermoplastic polymer (and pigment) is plasticized with a nonpolar liquid, preferably at elevated temperature, to form a sponge, the sponge is shredded, more nonpolar liquid is added, the pieces of shredded sponge are wet-ground into particles and the grinding is continued to pull the particles apart to form fibers extending therefrom (the particles preferably having a diameter less than 5 microns). Finally, a charge director may be added to impart a charge of predetermined polarity to the toner particles.

While the method of the aforementioned Published UK Patent Application includes the imparting of squash resistance to the image, it would nevertheless be desirable to fix a liquid image on a substrate by analogy with the application of heat and pressure in dry electrostatic imaging processes, but, as has been indicated above, this has not been possible hitherto because of the liability of liquid toner based images particularly, to smudging, smearing or squashing.

SUMMARY OF THE INVENTION

It is thus an object of the present invention to provide a shaped article which when heated may be employed for fusing and fixing a developed image in an electrostatic imaging process.

It is another object of the invention to provide a composition of matter adapted for the manufacture of the shaped article.

It is also an object of the invention to provide a method for reducing the adhesitivity at elevated temperatures of the surface of a shaped article.

A further object of the invention is to provide an improvement in the step in which heat and pressure are applied to fuse and fix the developed image in dry electrostatic imaging.

Yet a further object of the invention is to provide in an electrostatic imaging process which makes use of liquid toner, a fixing and fusing step which includes the application of heat and pressure to the developed liquid toner image, while minimizing the possibility of smudging, smearing or squashing the developed image.

Still a further object of the invention is to provide shaped articles which may be heated in a step of an electrostatic imaging process in which heat and pressure are applied to fuse and fix the developed image on a substrate, while minimizing offsetting the image.

Other objects of the invention will become apparent as the description proceeds.

According to an embodiment of the invention, there is provided a composition of matter which includes a release coating silicone polymer, and a soft silicone rubber formulation having a Shore A value of about 50 or less, the weight ratio of the release coating silicone polymer to soft silicone rubber formulation being in the range of from about 1:1.5 to about 1:20.

In accordance with an additional embodiment of the invention there is provided apparatus for fusing and fixing onto a substrate a developed image transferred thereto subsequent to being formed by a liquid toner electrostatic imaging process, the apparatus including a first movable member including a material operative to substantially prevent offset of a developed image passing in contact therewith; a second movable member defining a second contact surface portion of the second contact surface defining a nip with a portion of the first contact surface; apparatus for elevating the temperature of the developed image as it passes in contact with the first contact surface so as to cause thereby at least partial fixing and fusing of the developed image; and apparatus for applying a force through the nip so as to cause at least partial fusing and fixing of the developed image onto the substrate as it passes between the first and second movable surfaces.

Further in accordance with the foregoing embodiment, the material operative to substantially prevent offset is formed of a composition which includes a release coating silicone polymer, and a soft silicone rubber formulation having a Shore A value of about 50 or less, the weight ratio of the release coating silicone polymer to soft silicone rubber formulation being in the range of from about 1:1.5 to about 1:20.

Additionally in accordance with the foregoing embodiment, there is also provided apparatus for wetting the first contact surface with a wetting liquid.

In accordance with one embodiment of the invention, the wetting liquid is a silicone oil.

In accordance with another embodiment of the invention there is provided a method for reducing the adhesitivity at elevated temperatures of the surface of a shaped article formed from a soft silicone rubber formulation having a Shore A value of about 50 or less, which includes the step of admixing with about 1.5 to 20 parts by weight of the soft silicone rubber formulation prior to formation therefrom of the shaped article, about 1 part by weight of a release coating silicone polymer.

The invention moreover provides, in a further embodiment, a shaped article (such as one in the form of a sleeve for a roller or an endless belt) formed from a composition of matter including a soft silicone rubber formulation, the surface of which has a lower adhesitivity at elevated temperatures than the surface of such an article formed from the formulation alone, characterized in that prior to formation of the shaped article, the formulation in an amount of about 1.5 to 20 parts by weight has been subjected to a step of admixing with about 1 part by weight of a release coating silicone polymer.

In accordance with an additional embodiment of the invention, there is provided an electrostatic imaging process which includes the steps of generating a latent electrostatic image on a first substrate, developing the latent image with toner, transferring the developed image to a second substrate, and fusing and fixing the image thereon by application of heat and pressure to the second substrate-supported image by contacting it under pressure with a curved surface of a heated shaped article.

Further in accordance with the foregoing embodiment, the curved surface of the heated shaped article has been formed from a composition of matter including an admixture of about 1.5 to 20 parts by weight of a soft silicone rubber formulation with about 1 part by weight of a release coating silicone polymer.

Additionally in accordance with the foregoing embodiment, the process includes the adwetting the curved surface with a wetting liquid.

In accordance with one embodiment of the invention, the wetting liquid is a silicone oil.

Further in accordance with an embodiment of the invention, in the fusing and fixing step, the substrate is passed between the curved surface of the heated shaped article and a further curved surface defined by a shaped article formed from a soft rubber formulation.

Additionally in accordance with an embodiment of the invention, the ratio of the thickness of the shaped article formed from the composition of matter to the thickness of the shaped article formed from the soft rubber formulation lies within the range of about 1 to 30–80.

Further in accordance with an embodiment of the invention, the toner is powdered solid toner.

Additionally in accordance with an embodiment of the invention, the toner is liquid phase toner.

Further in accordance with an embodiment of the invention, the weight ratio of release coating silicone polymer to soft silicone rubber formulation is in the range of from about 1:3 to about 1:6.

Additionally in accordance with an embodiment of the invention, the weight ratio of release coating silicone polymer to soft silicone rubber formulation is about 1:4.

Further in accordance with an embodiment of the invention, the soft silicone rubber formulation includes an admixture of:

(i) about 1 to about 4 parts by weight of a curable silicone oil including curing agent therefor;

(ii) about 10 parts by weight of a hard rubber forming room temperature vulcanizable silicone polymer; and (iii) sufficient silicone polymer curing agent to effect a cure of component (ii).

Additionally in accordance with an embodiment of the invention, the ratio of components (i):(ii):(iii) is about 1–4: about 10: about 0.8–1.2, parts by weight.

Further in accordance with an embodiment of the invention, the ratio of components (i):(ii):(iii) is about 2: about 10: about 1, parts by weight.

Additionally in accordance with an embodiment of the invention, the soft silicone rubber formulation includes an admixture of:

(i) about 2 parts by weight of a curable silicone oil including curing agent therefor;

(ii) about 10 parts by weight of a hard rubber forming room temperature vulcanizable silicone polymer; and (iii) about 1 part of silicone polymer curing agent to effect a cure of component (ii).

In accordance with yet another embodiment of the invention, there is provided an imaging process which includes the steps of developing an image with liquid toner including a liquid carrier, fusing and fixing the image by the application of energy thereto, the improvement comprising preselecting at least the energy applied upon fusing and fixing and the properties of the liquid carrier, such that the liquid carrier is not substantially removed upon fixing and fusing.

Further in accordance with the foregoing embodiment, the improvement includes preselecting at least the conditions enumerated above, such that a major part of the liquid carrier is not removed upon fixing and fusing.

BRIEF DESCRIPTION OF THE DRAWINGS

The present invention will be understood and appreciated more fully from the following detailed description taken in conjunction with the drawings, in which.

DETAILED DESCRIPTION OF THE INVENTION

Figure 1:
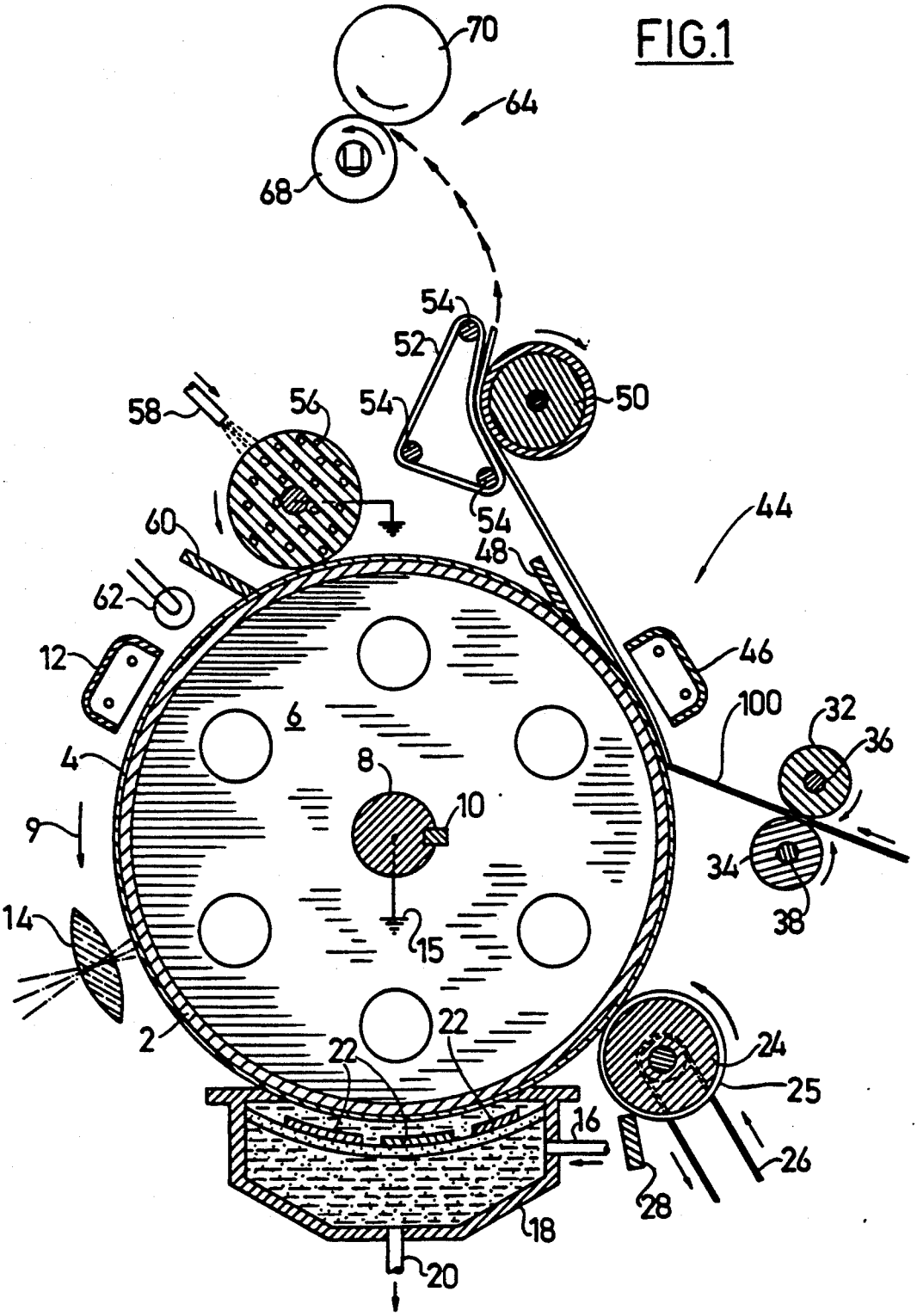
FIG. 1 is a schematic illustration of electrostatic imaging apparatus, constructed and operative in accordance with a preferred embodiment of the invention.

Reference is made to FIG. 1 in which there is shown electrostatic imaging apparatus employing a liquid toner. The apparatus includes a metal drum 2 which carries a photoconductor 4 and which is mounted by disks 6 onto a shaft 8. The disks are secured to shaft 8 by a key 10 so that the shown drum assembly, which is provided in a light-proof housing (not shown), is operative to rotate with shaft 8.

Shaft 8 is driven in any appropriate manner (not shown) in the direction of arrow 9 past a corona discharge device 12 operative to charge the surface of photoconductor 4. The image to be reproduced is projected onto the charged photoconductor by an optical system 14. Since shaft 8 is grounded at 15 and disks 6 are conductive, the areas struck by light conduct the charge, or a portion thereof, to ground, thus forming on the photoconductor an electrostatic latent image.

The liquid toner is circulated from any suitable source (not shown) through a pipe 16 into a development tray 18 from which it is drawn through a pipe 20 for recirculation. Development electrodes 22, which may be appropriately biased as known to the art, assist in toning the electrostatic latent image as it passes into contact with the toner.

As the amount of liquid on the photoconductor surface is normally too great for satisfactory subsequent transfer of the developed image, a roller 24, whose surface moves in a direction opposite to that of the photoconductor surface, is spaced from the Photoconductor surface by a spacer 25 and is operative to shear excess liquid from the developed image without disturbing it. An exemplary roller is shown in U.S. Pat. No. 3,907,423, the disclosure of which is incorporated herein by reference.

Roller 24 is driven, typically by a drive belt 26 which is in turn driven by any appropriate, known speed-controllable motor means (not shown). The roller is kept clean by a wiper blade 28.

A pair of register rollers 32 and 34 is operative to feed to a transfer station, referenced generally 44, a carrier sheet 100, which is to receive the developed image. At transfer station 44, a corona discharge device 46 is operative to impress upon the rear of the carrier sheet a charge of polarity opposite to that of the toner particles forming the developed image. The developed image is thus drawn towards the carrier sheet.

Rollers 32 and 34 are mounted onto and secured for rotation with respective axles 36 and 38. The axles are driven in synchronism so that there is no relative motion between the points of closest approach of the rollers 32 and 34 to each other. Alternatively, if desired, only one of the register rollers need be driven.

A pick-off member 48 assists in the removal from the photoconductor of the carrier sheet bearing the developed image. A roller 50 coacting with a plurality of flexible bands 52 mounted onto a plurality of rollers 54 delivers the carrier sheet to fusing and fixing apparatus, referenced generally 64. Apparatus 64 is described below in greater detail in conjunction with FIG. 2.

A cleaning roller 56, formed of an appropriate synthetic resin as known in the art, is driven in a direction opposite to that of photoconductor 4, so as to scrub clean the surface thereof. To assist in this action, insulating, nonpolar, nontoxic liquid may be fed through a pipe 58 to the surface of the cleaning roller 56. A wiper blade 60 completes the cleaning of the photoconductive surface. Any residual charge left on the photoconductive drum is extinguished by flooding the photoconductor surface with light from a lamp 62.

Figure 2:
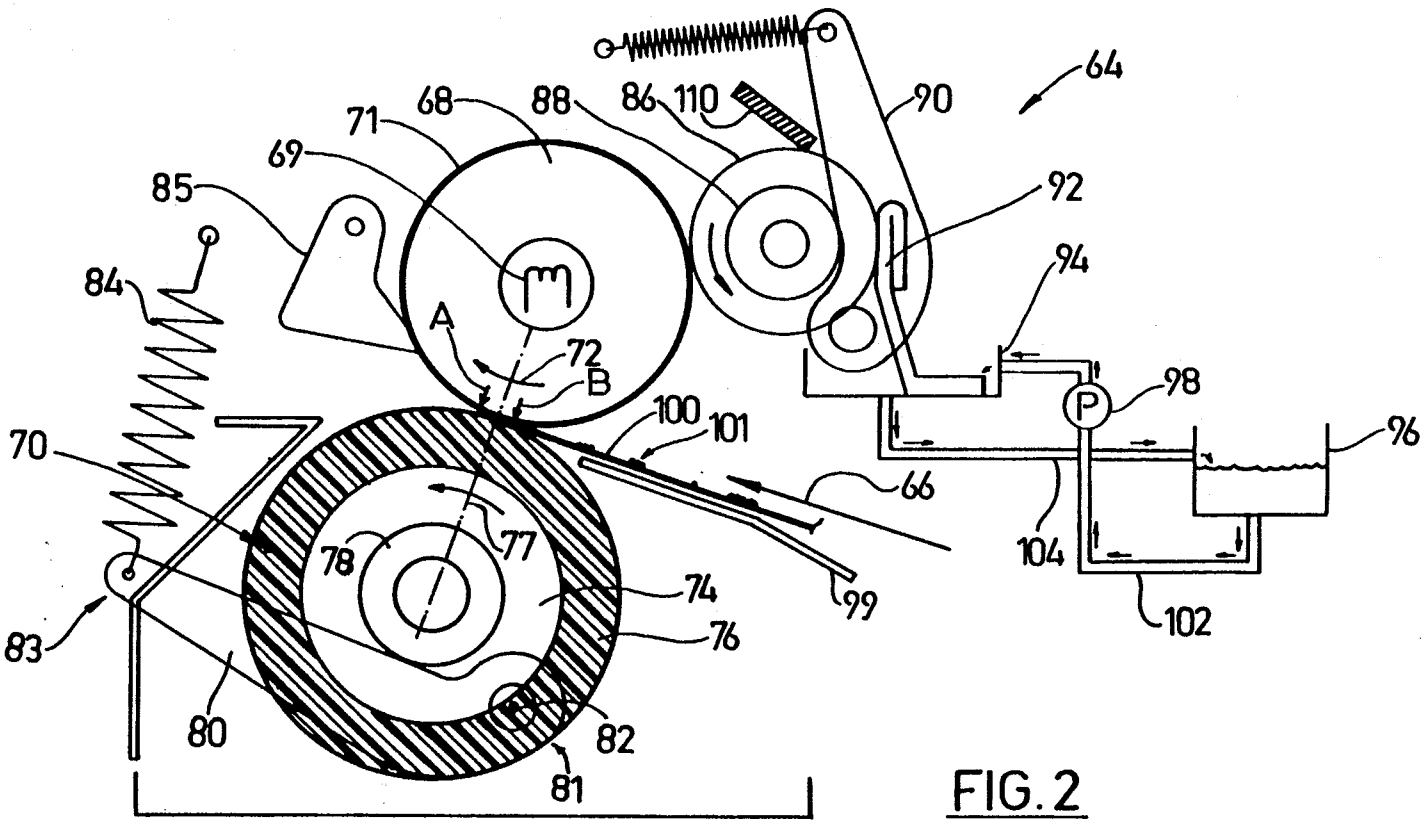
FIG. 2 is a more detailed schematic illustration of apparatus for fusing and fixing a developed image onto a carrier sheet, useful in the apparatus of FIG. 1.

Reference is now made to FIG. 2 in which there is shown fusing and fixing apparatus, constructed and operative in accordance with a preferred embodiment of the invention. Carrier sheet 100 is fed in the direction of an arrow 66 and, with the assistance of a guide member 99, between a heated roller 68 and a pressure roller 70 (see also FIG. 1).

In the shown embodiment, roller 68 is driven by any suitable means (not shown) and, as it rotates in a direction shown by arrow 72, it is also operative to cause rotation of roller 70 by friction. Roller 68 typically comprises a hollow metal cylindrical core in which is provided a heat source 69 which helps in fusing the developed image borne by the carrier sheet as it is drawn between rollers 68 and 70.

The metal core of roller 68 is coated with a thin layer 71 of a synthetic material having a composition as described hereinbelow. It is a particular feature of the invention that the composition of the synthetic material of which layer 71 is formed is such that the occurrence of offset of a developed image coming into contact with the layer is negligible.

Roller 70 comprises a cylindrical metal core 74 onto which there is mounted a sleeve 76 of a synthetic material having a hardness value of not greater than about 50 on the Shore A scale. A typical synthetic material is silicone rubber. According to a preferred embodiment of the invention, the ratio of the thickness of layer 71 to thickness of sleeve 76 is typically in the range of 1 to 30–80. For example, layer 71 may be 0.4 mm thick and sleeve 76 may be 20 mm thick.

Due to the difference in respective thicknesses of layer 71 and sleeve 76, roller 68 is much harder than roller 70. Consequently, when roller 70 presses against roller 68 along an axis 77, the surface of roller 70 becomes indented and a continuous contact length or 'nip' is formed between the rollers and between two points indicated by arrows A and B.

It is appreciated that as the carrier sheet is drawn into the nip, it is of great importance in ensuring that effective fusing and fixing of the image on the sheet takes place without the image being squashed, smeared or smudged. There is provided, therefore, apparatus for adjusting the pressure between rollers 68 and 70.

While roller 68 preferably rotates about a fixed axis, roller 70 is mounted for rotation onto an adjustable axle 78 which is supported by a support arm 80. Support arm 80 is rotatably mounted at one end 81 thereof, about a fixed axis 82 and is further supported, at another end 83 thereof, by a spring 84. It will be appreciated that the stronger the spring, the greater the pressure that is imposed by roller 70 onto roller 68.

As the carrier sheet is drawn between rollers 68 and 70, heat applied to the sheet from source 69 is effective, in combination with the pressure applied to the sheet by the rollers, to fuse and fix the developed image onto the sheet. According to the shown embodiment, the sheet is fed between the rollers such that the developed image, shown generally at 101, contacts the surface of roller 68. In known electrostatic imaging processes, it is expected that some offset onto roller 68 of the developed image will occur.

According to the present invention, layer 71 has a material composition that virtually eliminates offset while not giving rise to squashing, smudging or smearing of the developed image when used in a liquid toner process. While it is expected that offset of the image onto roller 68 is negligible, there is provided, nonetheless, a stripper 85 for removing any slight offset deposits that do occur and for ensuring proper paper removal.

A composition of matter according to the invention, having a Shore "A" hardness of less than 50 and comprising s release coating silicone polymer and a soft silicone rubber formulation is used for layer 71 of roller 68. The soft silicone rubber compound comprises for example an admixture of: (i) about 1 to about 4 parts by weight of a curable silicone oil including curing agent therefor; (ii) about 10 parts by weight of a hard rubber forming room temperature vulcanizable silicone polymer; and (iii) sufficient silicone polymer curing agent to effect a cure of component (ii), the ratio of components (i):(ii):(iii) being preferably about 1–4: about 10: about 0.8–1.2, parts by weight.

Examples of components (i), (ii) and (iii) are

| | | |
|---|---|---|
| (i) | RTV 910 | manufactured by General Electric (U.S.A.) |
| (ii) | RTV 615A, RTV 630A | |
| (iii) | RTV 615B, RTV 630B | |

Such components may be used in a weight ratio of, for example, about 2:10:1.

An example of a suitable release coating silicone polymer is Syl-Off 7600, an organofunctional siloxane polymer (cross-linkable with Syl-Off 7601 or Syl-Off 7048), manufactured by Dow Corning (U.S.A.), in particular in a ratio of approximately 200:1 of Syl-Off 7600 to Syl-Off 7601 or a ratio of approximately 500:1 of Syl-Off 7600 to Syl-Off 7048. These ratios are substantially higher than the manufacturers recommendation. Such small amounts of cross-linker are insufficient to completely cross-link the Syl-Off 7600. For example Dow Corning recommends that 100 parts of Syl-Off 7600 be used with 4.8 parts of Syl-Off cross linker, a ratio of 20:08:1.

While in general, weight ratios of release coating silicone polymer to soft silicone rubber formulation in the range of from about 1:1.5 to about 1:20 are believed to be generally operable, ratios of 1:3 to 1.6 give good results and it is presently preferred to use a weight ratio of about 1:4.

It has been found in accordance with the invention that when the inventive composition of matter as defined herein is formed into a shaped article, the surface of this article has a reduced adhesitivity at elevated temperatures, as compared with the surface of such an article from a soft silicone rubber formulation only. Such an article, especially when possessing a curved surface, is useful in the form of a roller, such as roller 68, or an endless band, as used in various electrostatic imaging processes.

As has already been indicated above, the application of heat and pressure in the fusing and fixing step of an electrostatic imaging process utilizing solid powdered toner is subject to the drawback that the developed image may, because of (inter alia) partial adhesion to the curved surface of the shaped article which it contacts, be undesirably reproduced by offsetting, as for example on heated roller 68 which, as described above, together with pressure roller 70 provides the required nip.

In accordance with the invention, however, if the coating on roller 68 is made from the composition of the invention, its surface which when heated contacts the toner image is much less liable to offsetting than when using known compositions for this purpose.

Also, whereas the application of heat and pressure in the fusing and fixing step of an electrostatic imaging process utilizing liquid phase toner has to the knowledge of the inventors proved to be impractical hitherto because of liability of the liquid toner image to smudging, smearing or squashing, the composition of the present invention now makes possible for the first time, the introduction of a step including the application of heat and pressure, in such liquid phase toner processes, by analogy with a corresponding step in powdered solid toner processes.

Thus, in accordance with an embodiment of the invention and with reference to FIGS. 1 and 2, an electrostatic imaging process is provided which includes the steps of generating a latent electrostatic image on photoconductor 4, developing the latent image with liquid toner from development tray 18, transferring the developed image to carrier sheet 100 and fusing and fixing the transferred image on the substrate by heat and pressure applied thereto preferably by passing it between rollers 68 and 70, roller 68 being formed from the novel composition of the present invention.

According to an alternative embodiment of the invention, the latent image may be developed by powdered, solid toner.

With further reference to FIG. 2, there is also provided apparatus for wetting heated roller 68 with silicone oil, such as 350F. It will be appreciated that wetting of roller 68 is important so as to prevent drying out of coating 71 thereon, due to oozing out from the rubber composition of a noncross-linked silicone oil used therein, for example, RTV 910.

The shown wetting apparatus comprises a wetting roller 86 which is mounted onto an adjustable axle 88, roller 86 being operative to rotate together with heated roller 68. There is also provided a spring-retained arm 90 which maintains contact between wetting roller 86 and roller 68 by applying pressure onto axle 88 in the direction of roller 68.

Wetting roller 86 is kept moist by a liquid absorbing element 92 which communicates with a trough 94 and which is maintained in touching contact with roller 86. Element 92 may, for example, comprise a layer of velvet mounted on a support. Trough 94 is typically supplied with silicone oil to a depth that is sufficient to keep element 92 damp enough so as to moisten wetting roller 86. A doctor blade 110 presses against roller 86 to reduce liquid thickness to preferably approximately 7 microns. Liquid is provided to trough 94 from an external reservoir 96 and is pumped therefrom at a very slow rate, by means of a pump 98 and an entry conduit 102. Excess liquid in trough 94 drains therefrom back into reservoir 96 via an outlet conduit 104.

A suitable toner solution for the process of the present invention may be prepared as follows. ELVAX II 5720 (Dupont) (1000 g.) and ISOPAR L (Exxon) (500 g.) are mixed together at a temperature of 90±10° C. for 1 hour, using a Ross Double Planetary mixture. Carbon black (Mogul L (Cabot), 250 g.) and ISOPAR L (500 g.) are added, and mixing is continued for 1 hour. ISOPAR L (2000 g.), preheated to 110° C. is added, and mixing is continued for a further 1 hour. The source of heat is withdrawn, while continuing mixing until the temperature has fallen to less than 40° C. Of the resultant mixture, 3050 g. are milled at a temperature of 40±2°-3° C. for about 22 hours with ISOPAR L (4000 g.) in a Sweco M18 Vibratory Mill containing 0.5" alumina cylinders. The product is a 12.5% solids concentrate; a working dispersion is obtained by diluting with ISOPAR L to a 1.5% solids content. In the Examples which follow, the Savin 870 photocopier requires 1.5 kg. of this working solution, to which is added 7-8 mi. of 10% lecithin in ISOPAR L as charge director, while the Savin V45 photocopier requires 0.8 kg. of this working solution, to which is added 3.5-4 mi. of 10% lecithin in ISOPAR L as charge director.

The invention will now be illustrated by the following non-limitative examples:

EXAMPLE 1

A Savin V45 photocopier which was modified to incorporate at the fixing and fusing stage a hot roller system as described above at an optimum temperature of 120±10° C. for minimum offset, was operated with a substrate speed of about 314 mm./sec., with a pressure of 6 kg. applied at each side of the pair of rollers, and using the liquid toner prepared as above. The length of the nip was about 4-6 mm. Under these conditions the major part of the ISOPAR L in the toner image was retained therein, while fusing and fixing was achieved.

EXAMPLE 2

A Savin 870 photocopier, having its internal fuser rendered inoperative, was used to generate copies on paper using the liquid toner prepared as described hereinabove. The copies were then subjected to flash illumination of about 0.75 Joule/cm$^2$ and 400 microsecond pulse duration. Under these conditions the major part of the ISOPAR L in the toner image was retained therein, while fusing and fixing was achieved.

It will be appreciated by persons skilled in the art that the present invention is not limited to what has been particularly shown and described hereinabove. The scope of the present invention is limited, rather, solely by the claims which follow.

We claim:

1. A composition of matter which comprises:

(A) a release coating silicone polymer;

(B) a cross-linker for (A) in an amount insufficient to substantially cross-link (A); and (C) a soft silicone rubber formulation, the weight ratio of (A) to (C) being in the range of from about 1:1.5 to about 1:20.

2. A composition according to claim 1 and wherein said weight ratio of (A) to (C) is in the range of from about 1:3 to about 1:6.

3. A composition according to claim 12, and wherein component (C) comprises an admixture of:

(i) about 1 to about 4 parts by weight of a curable silicone oil including curing agent therefor;

(ii) about 10 parts by weight of a hard rubber forming room temperature vulcanizable silicone polymer; and (iii) sufficient silicone polymer curing agent to effect a cure of component (ii).

4. A composition according to claim 3, and wherein the ratio of components (i):(ii):(iii) is about 1-4: about 10: about 0.8-1.2, parts by weight.

5. A composition according to claim 4, and wherein the ratio of components (i):(ii):(iii) is about 2: about 10: about 1, parts by weight.

6. A composition according to claim 1 and wherein said weight ratio of (A) to (C) is about 1:4.

7. A composition according to claim 3, and wherein component (C) comprise an admixture of:

(i) about 2 parts by weight of a curable silicone oil including curing agent therefor;

(ii) about 10 parts by weight of a hard rubber forming room temperature vulcanizable silicone polymer; and (iii) about 1 part of silicone polymer curing agent to effect a cure o component (ii).

8. A composition according to claim 1, and wherein component (C) comprises an admixture of:

(i) about 1-4 parts by weight of a curable silicone oil including curing agent therefor;

(ii) about 10 parts by weight of a hard rubber forming room temperature vulcanizable silicone polymer; and (iii) sufficient silicone polymer curing agent to effect a cure of component (ii).

9. A composition according to claim 8, and wherein the ratio of components (i):(ii):(iii) is about 2: about 10: about 1, parts by weight.

10. A composition of matter according to claim 1 wherein said composition of matter has a shore A hardness of less than 50.

11. A composition of matter according to claim 1 wherein said release coating silicone polymer comprises an organofunctional siloxane polymer.

12. A composition of matter according to claim 1 wherein said deficiency is more than about a factor of 5.

13. A composition of matter according to claim 1 wherein said deficiency is about a factor of 10.

14. Apparatus for fusing and fixing onto a substrate a developed image transferred thereto subsequent to being formed by a liquid toner electrostatic imaging process, said apparatus comprising:

a first movable member comprising a material operative to substantially prevent offset of a developed image passing in contact with a first contact surface thereof;

a second movable member defining a second contact surface portion of said second contact surface defining a nip with a portion of said first contact surface;

means for elevating the temperature of the developed image as it passes in contact with said first contact surface so as to cause thereby at least partial fixing and fusing of said developed image; and means for applying a force through said nip so as to cause at least partial fusing and fixing of said developed image onto said substrate as it passes between said first and second movable surfaces, and wherein said material operative to substantially prevent offset is formed of a composition comprising:

(A) a release coating silicone polymer;

(B) a cross-linker for (A) in an amount insufficient to completely cross-link (A); and (C) a soft silicone rubber formulation, the weight ratio of (A) to (C) being in the range of from about 1:1.5 to about 1:20.

15. Apparatus according to claim 14 and wherein said weight ratio of (A) to (C) is in the range of from about 1:3 to about 1.6.

16. Apparatus according to claim 15, and wherein component (C) comprises an admixture of:

(i) about 1 to about 4 parts by weight of a curable silicone oil including curing agent therefor;

(ii) about 10 parts by weight of a hard rubber forming room temperature vulcanizable silicone polymer; and (iii) sufficient silicone polymer curing agent to effect a cure of component (ii).

17. Apparatus according to claim 16, and wherein the ratio of components (i):(ii):(iii) is about 1–4: about 10: about 0.8–1.2, parts by weight.

18. Apparatus according to claim 17, and wherein the ratio of components (i):(ii):(iii) is about 2: about 10: about 1, parts by weight.

19. Apparatus according to claim 15, and also comprising means for wetting said first contact surface with a wetting liquid.

20. Apparatus according to claim 14 and wherein said weight ratio of (A) to (C) is about 1:4.

21. Apparatus according to claim 20, and wherein said component (C) comprises an admixture of:

(i) about 1 to about 4 parts by weight of a curable silicone oil including curing agent therefor;

(ii) about 10 parts by weight of a hard rubber forming room temperature vulcanizable silicone polymer; and (iii) sufficient silicone polymer curing agent to effect a cure o component (ii).

22. Apparatus according to claim 21, and wherein the ratio of components (i):(ii):(iii) is about 1–4: about 10: about 0.8–1.2, parts by weight.

23. Apparatus according to claim 14, and wherein component (C) comprises an admixture of:

(i) about 1–4 parts by weight of a curable silicone oil including curing agent therefor;

(ii) about 10 parts by weight of a hard rubber forming room temperature vulcanizable silicone polymer; and (iii) sufficient silicone polymer curing agent to effect a cure of component (ii).

24. Apparatus according to claim 23, and wherein the ratio of components (i):(ii):(iii) is about 2: about 10: about 1, parts by weight.

25. Apparatus according to claim 24, and wherein component (C) comprise an admixture of:

(i) about 2 parts by weight of a curable silicone oil including curing agent therefor;

(ii) about 10 parts by weight of a hard rubber forming room temperature vulcanizable silicone polymer; and (iii) about 1 part of silicone polymer curing agent to effect a cure of component (ii).

26. Apparatus according to claim 14 wherein said material operative to substantially prevent offset has a Shore A hardness of less than 50.

27. Apparatus according to claim 14 wherein said release coating silicone polymer comprises an organofunctional siloxane polymer.

28. Apparatus according to claim 14 wherein said deficiency is more than about a factor of 5.

29. Apparatus according to claim 14 wherein said deficiency is about a factor of 10.

30. A method for reducing the adhesitivity at elevated temperatures of the surface of a shaped article formed from a soft silicone rubber formulation having a Shore A value of about 50 or less, which comprises the step of admixing with about 1.5 to 20 parts by weight of said soft silicone rubber formulation prior to formation therefrom of said shaped article, about 1 part by weight of a release coating silicone polymer and a crosslinker for said release coating silicone polymer in an amount insufficient to substantially cross link said release coating silicone polymer.

31. A method according to claim 30 and wherein said weight ratio of release coating silicone polymer to soft silicone rubber formulation is in the range of from about 1:3 to about 1:6.

32. A method according to claim 31 and wherein said soft silicone rubber formulation comprises an admixture of:

(i) about 1 to about 4 parts by weight of a curable silicone oil including curing agent therefor;

(ii) about 10 parts by weight of a hard rubber forming room temperature vulcanizable silicone polymer; and (iii) sufficient silicone polymer curing agent to effect a cure of component (ii).

33. A method according to claim 32, and wherein the ratio of components (i):(ii):(iii) is about 1–4: about 10: about 0.8–1.2, parts by weight.

34. A method according to claim 33, and wherein the ratio of components (i):(ii):(iii) is about 2: about 10: about 1, parts by weight.

35. A method according to claim 30 and wherein said weight ratio of release coating silicone polymer to soft silicone rubber formulation is about 1:4.

36. A method according to claim 35, and wherein said soft silicone rubber formulation comprises an admixture of:

(i) about 2 parts by weight of a curable silicone oil including curing agent therefor;

(ii) about 10 parts by weight of a hard rubber forming room temperature vulcanizable silicone polymer; and (iii) about 1 part of silicone polymer curing agent to effect a cure of component (ii).

37. A method according to claim 30, and wherein said soft silicone rubber formulation comprises an admixture of:

(i) about 1–4 parts by weight of a curable silicone oil including curing agent therefor;

(ii) about 10 parts by weight of a hard rubber forming room temperature vulcanizable silicone polymer; and (iii) sufficient silicone polymer curing agent to effect a cure of component (ii).

38. A method according to claim 37, and wherein the ratio of components (i):(ii):(iii) is about 2: about 10: about 1, parts by weight.

39. A method according to claim 30 wherein said shaped article has a Shore A hardness of less than 50.

40. Apparatus according to claim 30 wherein said release coating silicone polymer comprises an organofunctional siloxane polymer.

41. A shaped article formed from a composition of matter comprising a soft silicone rubber formulation, the surface of which has a lower adhesitivity at elevated temperatures than the surface of such an article formed from said formulation alone, characterized in that prior to formation of said shaped article, said formulation in an amount of about 1.5 to 20 parts by weight has been subjected to a step of admixing with about 1 part by weight of a release coating silicone polymer and a cross-linker for said release coating silicone polymer in an amount insufficient to substantially cross link said release coating silicone polymer.

42. A shaped article according to claim 41 and wherein said weight ratio of release coating silicone polymer to soft silicone rubber formulation is in the range of from about 1:3 to about 1:6.

43. A shaped article according to claim 42, and wherein said soft silicone rubber formulation comprises an admixture of:

(i) about 1 to about 4 parts by weight of a curable silicone oil including curing agent therefor;

(ii) about 10 parts by weight of a hard rubber forming room temperature vulcanizable silicone polymer; and (iii) sufficient silicone polymer curing agent to effect a cure of component (ii).

44. A shaped article according to claim 43, and wherein the ratio of components (i):(ii):(iii) is about 1–4: about 10: about 0.8–1.2, parts by weight.

45. A shaped article according to claim 44, and wherein the ratio of components (i):(ii):(iii) is about 2: about 10: about 1, parts by weight.

46. A shaped article according to claim 41 and wherein said weigh ratio of release coating silicone polymer to soft silicone rubber formulation is about 1:4.

47. A shaped article according to claim 46, and wherein said soft silicone rubber formulation comprises an admixture of:

(i) about 2 parts by weight of a curable silicone oil including curing agent therefor;

(ii) about 10 parts by weight of a hard rubber forming room temperature vulcanizable silicone polymer; and (iii) about 1 part of silicone polymer curing agent to effect a cure of component (ii).

48. A shaped article according to claim 41, and wherein said soft silicone rubber formulation comprises an admixture of:

(i) about 1–4 parts by weight of a curable silicone oil including curing agent therefor;

(ii) about 10 parts by weight of a hard rubber forming room temperature vulcanizable silicone polymer; and (iii) sufficient silicone polymer curing agent to effect a cure of component (ii).

49. A shaped article according to claim 48, and wherein the ratio of components (i):(ii):(iii) is bout 2: about 10: about 1, parts by weight.

50. A shaped article according to claim 41 wherein said composition of matter has a Shore A hardness of less than 50.

51. A shaped article according to claim 41 wherein said release coating silicone polymer comprises an organofunctional siloxane polymer.

52. An electrostatic imaging process which comprises the steps of generating a latent electrostatic image on a first substrate, developing the latent image with toner, transferring the developed image to a second substrate and fusing and fixing the image thereon by application of heat and pressure to the second substrate-supported image by contacting it under pressure with a curved surface of a heated shaped article which has been formed from a composition of matter comprising an admixture of about 1.5 to 20 parts by weigh of a soft silicone rubber formation with about 1 part by weight of a release coating silicone polymer and a cross-linker for said release coating silicone polymer in an amount insufficient to substantially cross link said release coating silicone polymer.

53. An electrostatic imaging process according to claim 52 and wherein said weight ratio of release coating silicone polymer to soft silicone rubber formulation is in the range of from about 1:3 to about 1:6.

54. An electrostatic imaging process according to claim 53, and wherein said soft silicone rubber formulation comprises an admixture of:

(i) about 1 to about 4 parts by weight of a curable silicone oil including curing agent therefor;

(ii) about 10 parts by weight of a hard rubber forming room temperature vulcanizable silicone polymer; and (iii) sufficient silicone polymer curing agent to effect a cure of component (ii).

55. An electrostatic imaging process according to claim 54, and wherein the ratio of components (i):(ii):-(iii) is about 1–4: about 10: about 0.8–1.2, parts by weight.

56. An electrostatic imaging process according to claim 55, and wherein the ratio of components (i):(ii):-(iii) is about 2: about 10: about 1, parts by weight.

57. An electrostatic imaging process according to claim 53, which comprises the additional step of wetting said curved surface with a wetting liquid.

58. An electrostatic imaging process according to claim 57, and wherein said wetting liquid is a silicone oil.

59. An electrostatic imaging process according to claim 53, and wherein in said fusing said fixing step, and substrate is passed between said curved surface of said heated shaped article and a further curved surface defined by a shaped article formed from a soft rubber formulation.

60. An electrostatic imaging process according to claim 59, and wherein the ratio of the thickness of said shaped article formed from said composition of matter to the thickness of said shaped article formed from said soft rubber formulation lies within the range of about 1 to 30–80.

61. An electrostatic imaging process according to claim 52 and wherein said weight ratio of release coating silicone polymer to soft silicone rubber formulation is about 1:4.

62. An electrostatic imaging process according to claim 61, and wherein said soft silicone rubber formulation comprises an admixture of:

(i) about 2 parts by weight of a curable silicone oil including curing agent therefor;

(ii) about 10 parts by weight of a hard rubber forming room temperature vulcanizable silicon polymer; and (iii) about 1 part of silicone polymer curing agent to effect a cure of component (ii).

63. An electrostatic imaging process according to claim 52, and wherein said soft silicone rubber formulation comprises an admixture of:

(i) about 1–4 parts by weight of a curable silicone oil including curing agent therefor;

(ii) about 10 parts by weight of a hard rubber forming room temperature vulcanizable silicone polymer; and (iii) sufficient silicone polymer curing agent to effect a cure of component (ii).

64. An electrostatic imaging process according to claim 63, and wherein the ratio of components (i):(ii):-(iii) is about 2: about 10: about 1, parts by weight.

65. An electrostatic imaging process according to claim 52, and wherein said toner is powdered solid toner.

66. A process according to claim 52 wherein said composition of matter has a Shore A hardness of less than 50.

67. A process according to claim 52 wherein said release coating silicone polymer comprises an organofunctional siloxane polymer.

* * * * *